US007784252B2

(12) United States Patent
Cere'

(10) Patent No.: US 7,784,252 B2
(45) Date of Patent: Aug. 31, 2010

(54) UNIT FOR POSITIONING A SHEET OF FILM TO COVER THE TOPS OF PRODUCT GROUPS

(75) Inventor: Mauro Cere', Loiano (IT)

(73) Assignee: Aetna Group S.p.A., Rimini (IT)

( * ) Notice: Subject to any disclaimer, the term of this patent is extended or adjusted under 35 U.S.C. 154(b) by 774 days.

(21) Appl. No.: 11/705,234

(22) Filed: Feb. 12, 2007

(65) Prior Publication Data

US 2007/0189762 A1 Aug. 16, 2007

(30) Foreign Application Priority Data

Feb. 13, 2006 (IT) ..... BO2006A0099

(51) Int. Cl.
*B65B 53/00* (2006.01)

(52) U.S. Cl. ..... 53/556; 53/461; 53/203; 53/228

(58) Field of Classification Search ..... 53/461, 53/463, 465, 176, 203, 210, 218, 228, 556, 53/389.1–389.3
See application file for complete search history.

(56) References Cited

U.S. PATENT DOCUMENTS

| | | | | |
|---|---|---|---|---|
| 4,513,558 | A * | 4/1985 | Treiber | 53/77 |
| 4,583,348 | A * | 4/1986 | Treiber et al. | 53/441 |
| 4,936,080 | A | 6/1990 | Haloila | |
| 5,595,042 | A * | 1/1997 | Cappi et al. | 53/66 |
| 5,603,198 | A * | 2/1997 | Rimondi et al. | 53/441 |
| 6,170,236 | B1 * | 1/2001 | Whitby et al. | 53/441 |
| 6,189,302 | B1 * | 2/2001 | Kudo et al. | 53/556 |

(Continued)

FOREIGN PATENT DOCUMENTS

| | | |
|---|---|---|
| DE | 44 13 361 | 12/1994 |

(Continued)

OTHER PUBLICATIONS

European Search Report for Application No. EP 07 10 1903.

*Primary Examiner*—Hemant M Desai
(74) *Attorney, Agent, or Firm*—Fay Sharpe LLP

(57) ABSTRACT

A unit for positioning a sheet (1) of film (2) to cover the tops of product groups (3) comprises: a second roll (12) of film (2); a first carriage (13) that is slidably mounted on guide rails (14) running along an upper horizontal plane and is driven in both directions along the wrapping area (10) by motorized movement means (15); the first carriage (13) is equipped with a first gripper unit (16) designed to grip the free end of the film (2) and to unwind the film (2) for a predetermined length; film (2) cutting means (17) located in the vicinity of the second roll (12) and designed to separate the length of film thus unwound from the rest of the film (2); a second carriage (18) slidably mounted on the guide rails (14) in the vicinity of the cutting means (17); a second gripper unit (19) mounted on the second carriage (18), acting on the film (2) in such a way as to hold the sheet (1) at a second retention point when the cutting means (17) are activated; means (20) for coupling the second carriage (18) to the motorized movement means (15) in such a way that, when engaged, the two carriages (13, 18) can move together as one in order to position the sheet (1) centrally on the top surface of the product group (3).

12 Claims, 7 Drawing Sheets

U.S. PATENT DOCUMENTS

| | | | | |
|---|---|---|---|---|
| 6,192,662 | B1 * | 2/2001 | Rimondi et al. | 53/556 |
| 6,584,752 | B1 | 7/2003 | Herava | |
| 7,594,371 | B2 * | 9/2009 | Suolahti | 53/389.3 |

FOREIGN PATENT DOCUMENTS

| | | |
|---|---|---|
| EP | 0 336 517 | 10/1989 |
| EP | 1 149 767 | 10/2001 |
| FR | 2 639 611 | 6/1990 |
| NL | 8 501 270 | 12/1986 |
| WO | WO 00/53498 | 9/2000 |
| WO | WO 00/66434 | 11/2000 |

* cited by examiner

UNIT FOR POSITIONING A SHEET OF FILM TO COVER THE TOPS OF PRODUCT GROUPS

BACKGROUND OF THE INVENTION

This invention relates to a unit for positioning a sheet of film to cover the tops of product groups.

At present, stretch or shrink wrapping machines include units for positioning a sheet of film, cut to size, on the top of each group of products to be wrapped so as to provide a better hold on all the surfaces of the group of products.

These units may be used in any of several types of prior art wrapping machines and apparatuses, including, in a first solution, those with a vertically mobile ring where a roll mounting unit is moved relative to the product being wrapped.

In another solution, the wrapping apparatus comprises an L-shaped arm which mounts a roll unit that rotates around the group of products.

In yet another type of wrapping apparatus, it is the product to be wrapped that is moved relative to the roll unit.

Usually, a machine of the first type mentioned above comprises a mounting frame, normally bridge-shaped, and a roll mounting carriage supported on another structure which is in turn supported by the mounting frame. The mounting frame is normally located near a roller, belt or other suitable conveying system which feeds the products to be wrapped, usually on pallets, and positions them in the middle of the wrapping area.

The roll carriage mounts a roll of stretch plastic film and, usually, a unit for unwinding and pre-stretching the film from the roll.

The unit for positioning the top cover sheet may be positioned at the top of the mounting frame of these machines, said unit essentially comprising:

a roll of film positioned horizontally;

a power-driven gripper unit running on rails horizontally along the top of the wrapping area and designed to grip the free end of the film and to unwind a predetermined length of it, depending on the size of the group of products;

film cutting means located in the vicinity of the roll and designed to separate the length of film thus unwound from the rest of the film on the roll.

After being cut off, the sheet of film is released also by the gripper unit and allowed to fall onto the top of the group of products.

It is clear that a unit made in this way has several drawbacks due to: the low degree of precision in positioning the sheet; the high risk of the sheet getting crumpled as it moves down over the product; the low speed at which the operation is performed compared to usual wrapping machine speeds; and, in some cases, the incorrect distribution of the film on the top of the products (too much on some sides and too little on the others).

In one solution aimed at improving the units described above (see patent EP 336.517) a film unwinding unit and the gripper unit are moved simultaneously towards each other from opposite sides (by suitable means and guides) in such a way as to meet at the half way line of the wrapping area where the end of the film is gripped by the gripper unit and the two units are moved apart again so as to unwind the film to the required length which can then be cut off.

This solution, though an improvement over prior solutions, requires cumbersome guide structures, two drive systems and means for synchronizing the movements of the unwinding unit with those of the gripper unit, all of which add up to considerably increasing the size and cost of the unit.

SUMMARY OF THE INVENTION

The present invention has for an aim to overcome the above mentioned disadvantages by providing a unit which can position a sheet of film to cover the tops of product groups which is extremely simple, reduced in size, and permits the achievement of good productivity levels and a high degree of positioning precision.

According to the invention, this aim is achieved by a unit for positioning a sheet of film to cover the tops of product groups and, more specifically, a unit for positioning a sheet of film to cover the tops of product groups comprising the technical characteristics defined in one or more of the annexed claims.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figure 1:
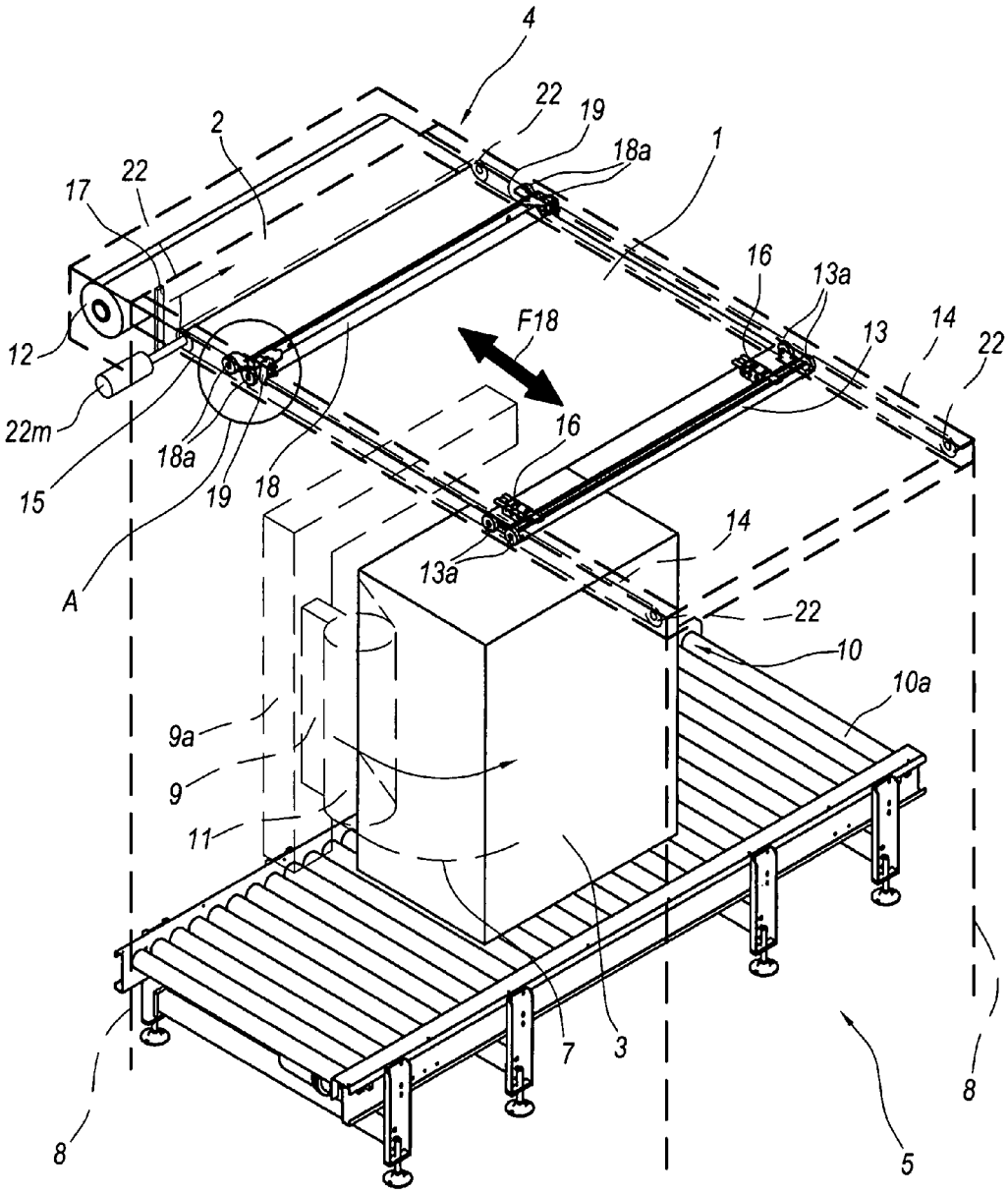
FIG. 1 is a schematic perspective view, with some parts cut away, of an apparatus for wrapping groups of products with film equipped with a unit according to the invention for positioning a sheet of film to cover the tops of product groups.
Figure 2:
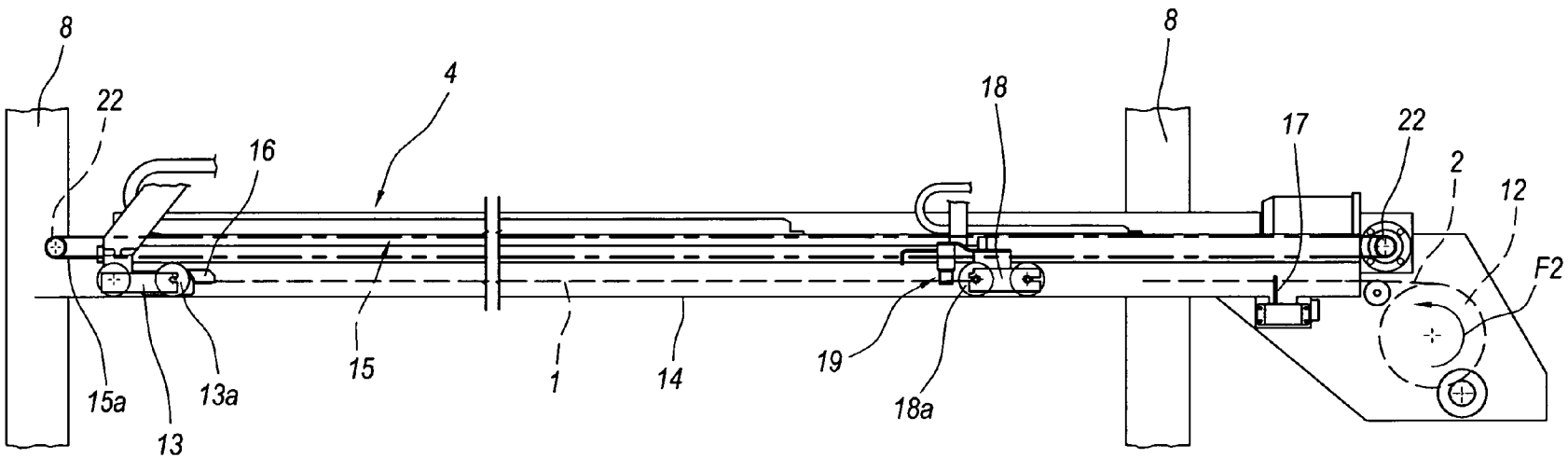
FIG. 2 is a schematic side view, with some parts cut away to better illustrate others, of the unit of FIG. 1 for positioning a sheet of film to cover the tops of product groups.

With reference to the accompanying drawings, in particular FIG. 1, the unit according to the invention, denoted in its entirety by the numeral 4, is used to position a sheet 1 of film 2 to cover the tops of product groups 3.

More specifically, the unit 4 is associated with an apparatus 5 for wrapping product groups 3 with film 7 of substantially the same type as the film used to cover the tops of the products.

The apparatus 5 may be one of several different types, FIG. 1 showing one by way of a non-limiting example of the solution according to the invention, it being understood that the unit according to the invention can be applied to wrapping apparatus with a different structure (with vertically mobile ring, for example).

The apparatus 5 illustrated comprises a frame 8 mounting an L-shaped arm 9*a* slidably engaged with a carriage 9 that moves relative to the group 3 of products to be wrapped with the film 7 to define a wrapping area 10 through which the product groups 3 are moved and where they are positioned for example by a roller conveyor 10*a*.

The carriage 9 in turn mounts a first roll 11 of film for wrapping the group 3 of products (these parts being illustrated schematically since they are of known type) and the roll is moved by the carriage 9 up and down along the arm 9*a*.

The frame 8 also mounts the above mentioned positioning unit 4 which essentially comprises a second roll 12, a first horizontally mobile carriage 13 equipped with a first gripper unit 16 and means 17 for cutting the film 2.

Looking in more detail, the second roll 12 of film 2 is positioned horizontally and, usually, outside the wrapping area 10.

The first carriage 13 is slidably mounted, on both sides, on guide rails 14 running along an upper horizontal plane, and is driven in both directions along the wrapping area 10 by motorized movement means 15 (see arrow F13).

As mentioned above, the first carriage 13 mounts the first gripper unit 16 designed to grip the free end of the film 2 and to unwind the film 2 for a predetermined length, dependent on the size of the product group 3, (the gripper unit 16 being illustrated schematically since it is of a type well known to those familiar with the trade).

The film 2 cutting means 17 are located in the vicinity of the second roll 12 and are designed to separate the unwound length of film from the rest of the film 2 to define the sheet 1. The cutting means 17 usually consist of a blade that slides parallel with the second roll 12 and are also equipped with means for keeping the free end of the film 2 protruding from the roll 12 in an aligned condition after the sheet 1 has been cut off.

Figure 3:
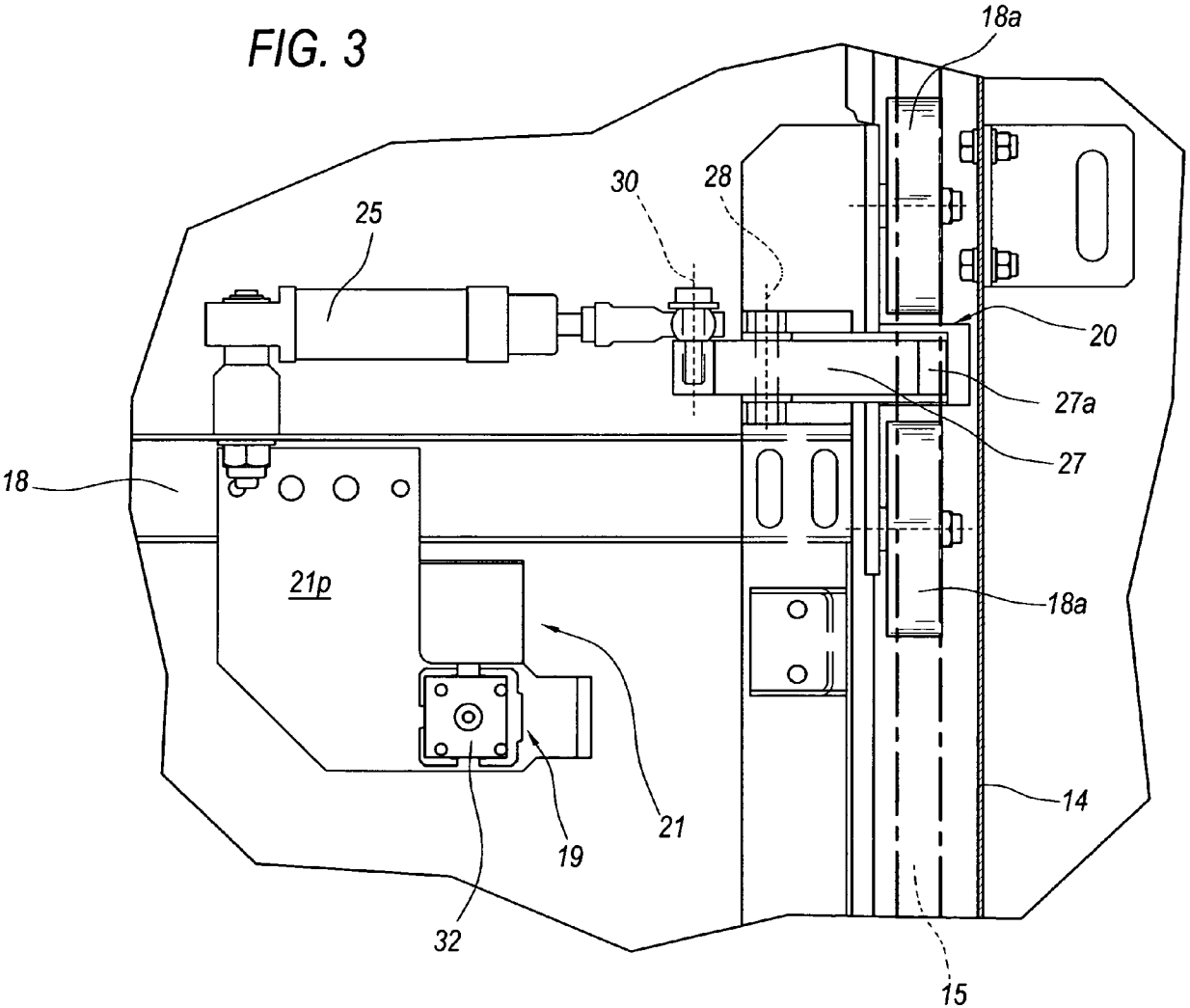
FIG. 3 is a schematic top plan view showing a detail A of the positioning unit of FIG. 1.

As may be inferred from FIGS. 1 and 3, the motorized movement means may comprise an endless belt 15 trained around one pair of wheels 22 for each mounting rail 14 present. One of the four wheels 22 is connected to a single drive 22*m* for activating the two belts 15.

As illustrated also in FIGS. 2 to 5, each mounting rail consists of a C section beam 14, the lower horizontal section of the C slidably supporting a respective first wheel unit 13*a* associated with the ends of the first carriage 13.

Figure 6:
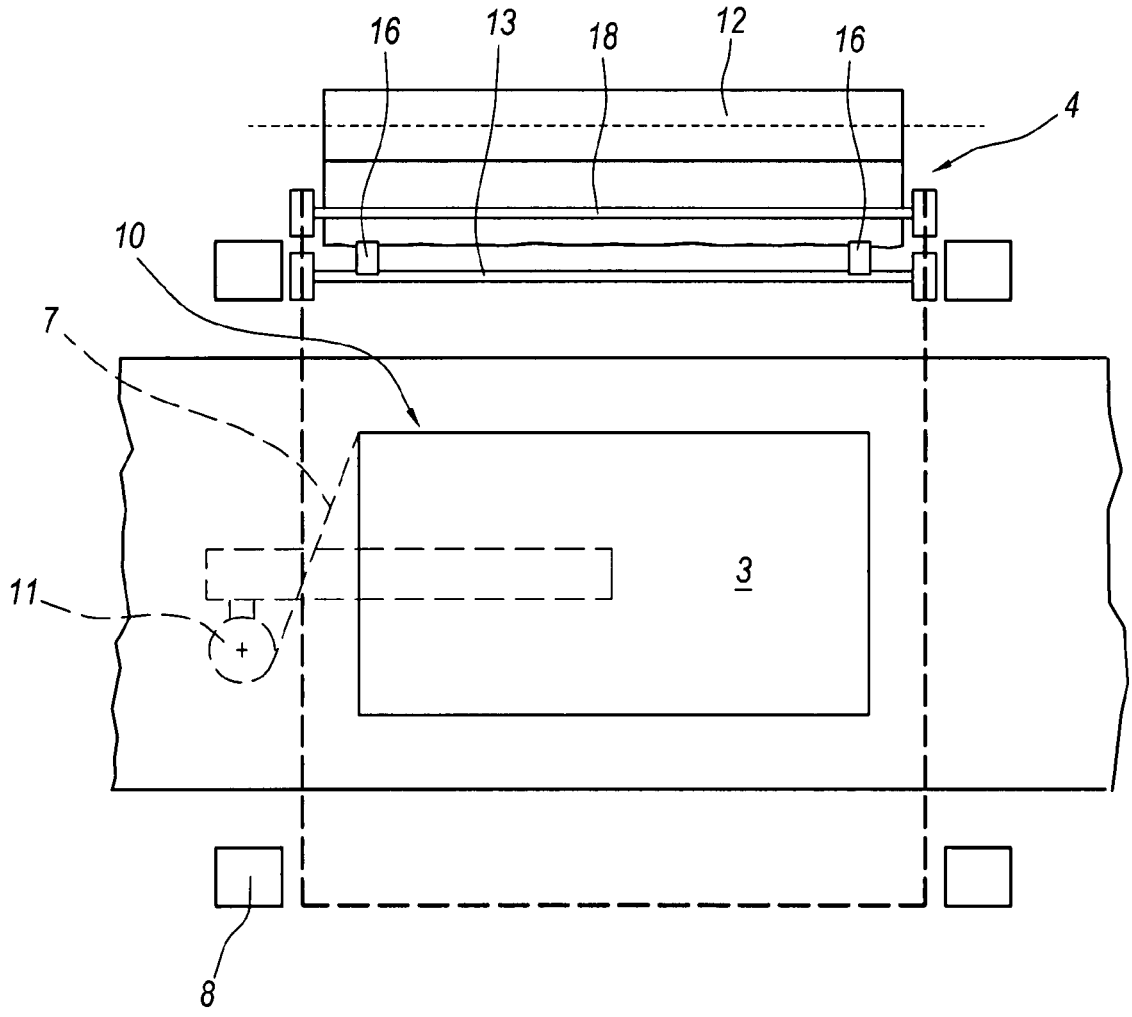
FIGS. 6 to 8 are schematic top plan views, with some parts cut away to better illustrate others, of respective steps of positioning the sheet on the group of products using the unit illustrated in the drawings listed above.
Figure 8:
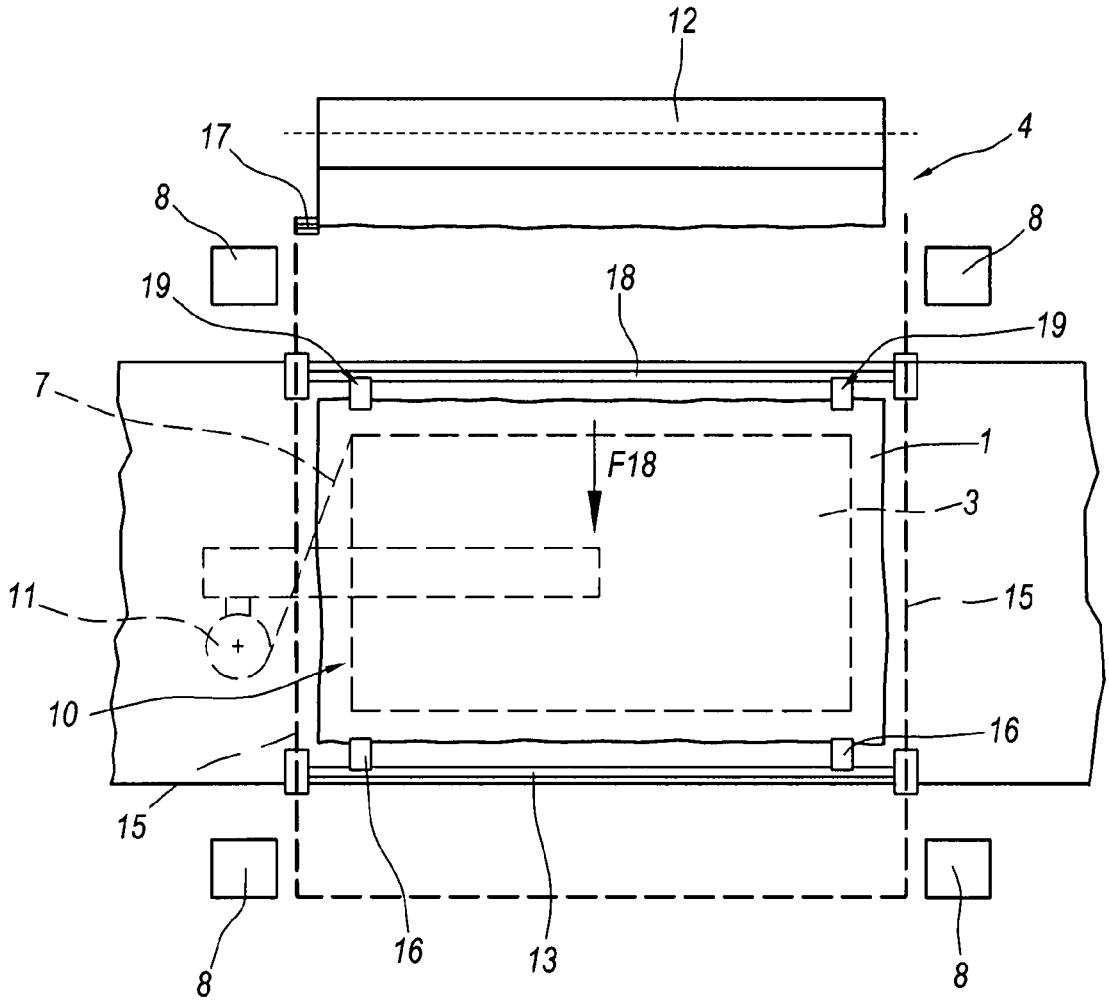

In addition to the above, the unit 4 comprises (see also FIGS. 6 to 8):

a second carriage 18 slidably mounted on the guide rails 14 opposite the first carriage 13 and in the vicinity of the cutting means 17 (FIG. 6);

a second gripper unit 19 mounted on the second carriage 18, acting on the film 2 in such a way as to hold the sheet 1 at a second point when the cutting means 17 are activated;

means 20 for coupling the second carriage 18 to the motorized movement means 15 (that is to say, to the belts) in such a way that, when engaged, the two carriages 13 and 18 can move together as one (see arrows F18 in FIGS. 1 and 8) in order to position the sheet 1 centrally on the top surface of the product group 3 to be covered (FIG. 8).

The second carriage 18 is also equipped with means 21 for supporting the passing film 2 while it is being unwound by the first carriage 13.

More specifically, the supporting means 21 define a contact base for the second gripper unit 19 enabling the latter to hold the sheet 2 at the second retention point when the cutting means 17 are activated (as described in more detail below).

Figure 4:
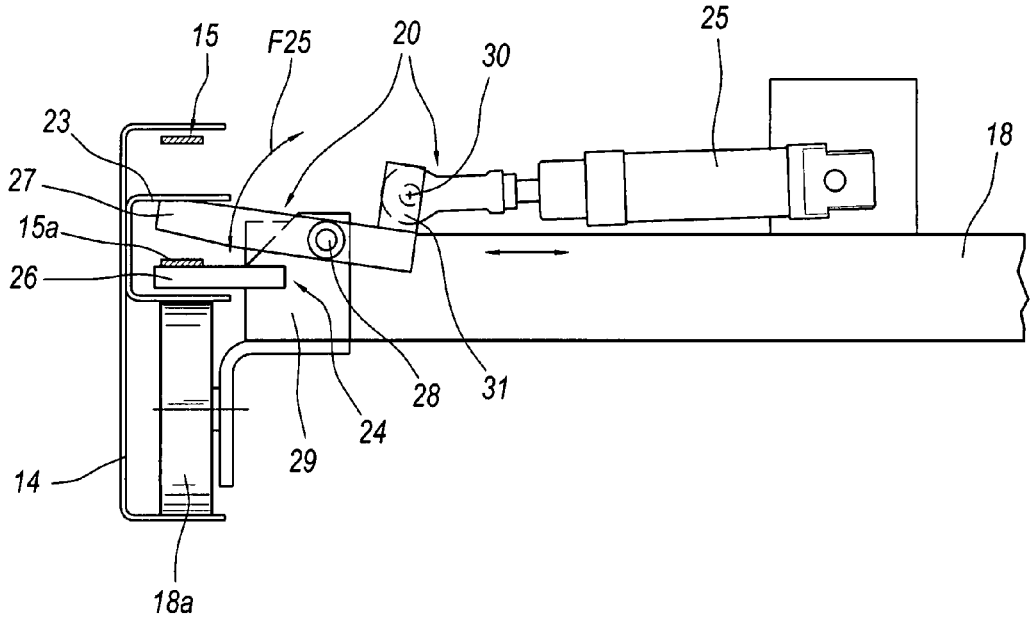
FIGS. 4 and 5 are schematic front views of the detail of FIG. 3 showing coupling means in two different working configurations.
Figure 5:
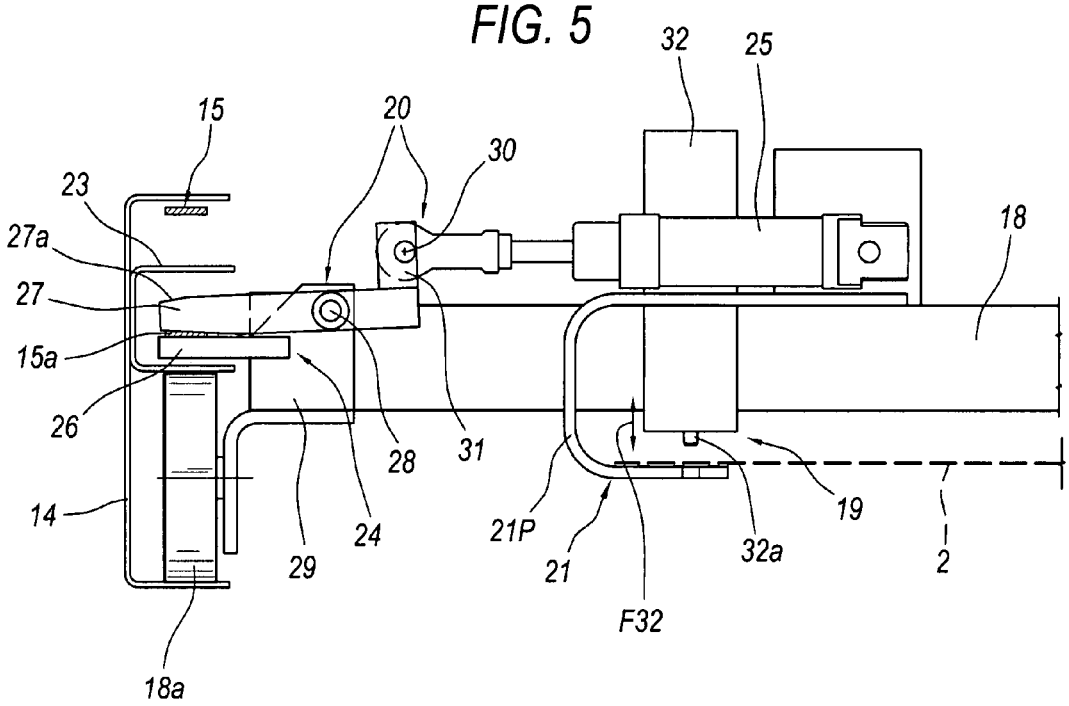

As illustrated in FIGS. 3 to 5, the coupling means 20 are located at the two ends of the second carriage 18 and act on a section 15*a* of the respective belts 15 with which the first carriage 13 is stably associated. The second carriage 18 is, in part, structurally similar to the first carriage 13, that is to say, it also has a wheel unit 18*a* for each end of it and running along the lower horizontal section of the C of each beam 14.

To accommodate the coupling means 20, each beam 14 also has an inner beam 23 attached, inside the "C", to the vertical section of the beam 14 and positioned above the area where the wheel units 13*a* and 18*a* pass.

The belt 15 section 15*a*, which is acted upon by the coupling means 20 and to which the first carriage 13 is attached, slides inside the inner beam 23.

Looking more closely at the technical details, the coupling means 20 comprise, a clamping member 24 located at and associated with each end of the second carriage 18.

Each clamping member 24 at least partly and transversely engages the respective inner C-beam 23 in such a way as to face both sides of the section 15*a* of the belt 15.

Each of the clamping members 24 is acted upon by an actuator 25 designed to move the clamping member 24 between a configuration where the section 15*a* of the belt 15 is stably gripped so as to perform the joint movement with the first carriage 13 and a configuration where the belt section 15*a* is released (see FIGS. 4 and 5 and arrows F25).

More specifically, each clamping member 24 consists of:

a fixed contact base 26 attached to the second carriage 18, extending into the inner C-beam 23 under the area where the section 15*a* of the belt 15 is engaged;

a mobile claw 27 hinged at 28 to a support 29 of the second carriage 18 and extending into the inner C-beam 23.

The outside free end of the claw 27 is acted upon by the actuator 25.

One end of the latter is linked to the second carriage 18 while the other end is pivoted at 30 to a drive arm 31 attached to the mobile claw 27: this kinematic configuration enables the claw 27 to turn between a raised, idle position where the claw 27 is away from the section 15*a* of the belt 15 (see FIG. 4) and a lowered, working position where the claw 27 is in contact with the section 15*a* which is positioned between the claw 27 itself and the fixed contact base 26 (see FIG. 5).

As shown in FIG. 4, the mobile claw 27, in the idle position, is pressed against the upper side of the inner C-beam 23 with an inclined profile surface 27*a* of it in such a way as to stop the carriage 18 at the corresponding position: this enables the second carriage 18 to be kept firmly in a precise position when not used.

Returning now to the second gripper unit 19 and to the supporting means 21 (see FIGS. 3 to 5), the second gripper unit 19 comprises the following:

a pair of supporting means 21, each consisting of contact plates 21*p* associated with the second carriage 18 and having an L-shaped portion protruding downwardly under the second carriage 18 in such a way that its horizontal section supports the longitudinal edge film 2 being unwound;

a pair of vertical actuating pressers 32 positioned on the second carriage 18 in the vicinity of the plates 21*p* in such a way as to face the horizontal section of the shaped portion.

Each actuator 32 is mobile between an idle position where the working head 32*a* of the rod is away from the horizontal section and a working position where the working head 32*a* stops the film 2 between the head 32*a* itself and the horizontal section of the plate 21*p* (see arrow F32, FIG. 5).

Figure 7:
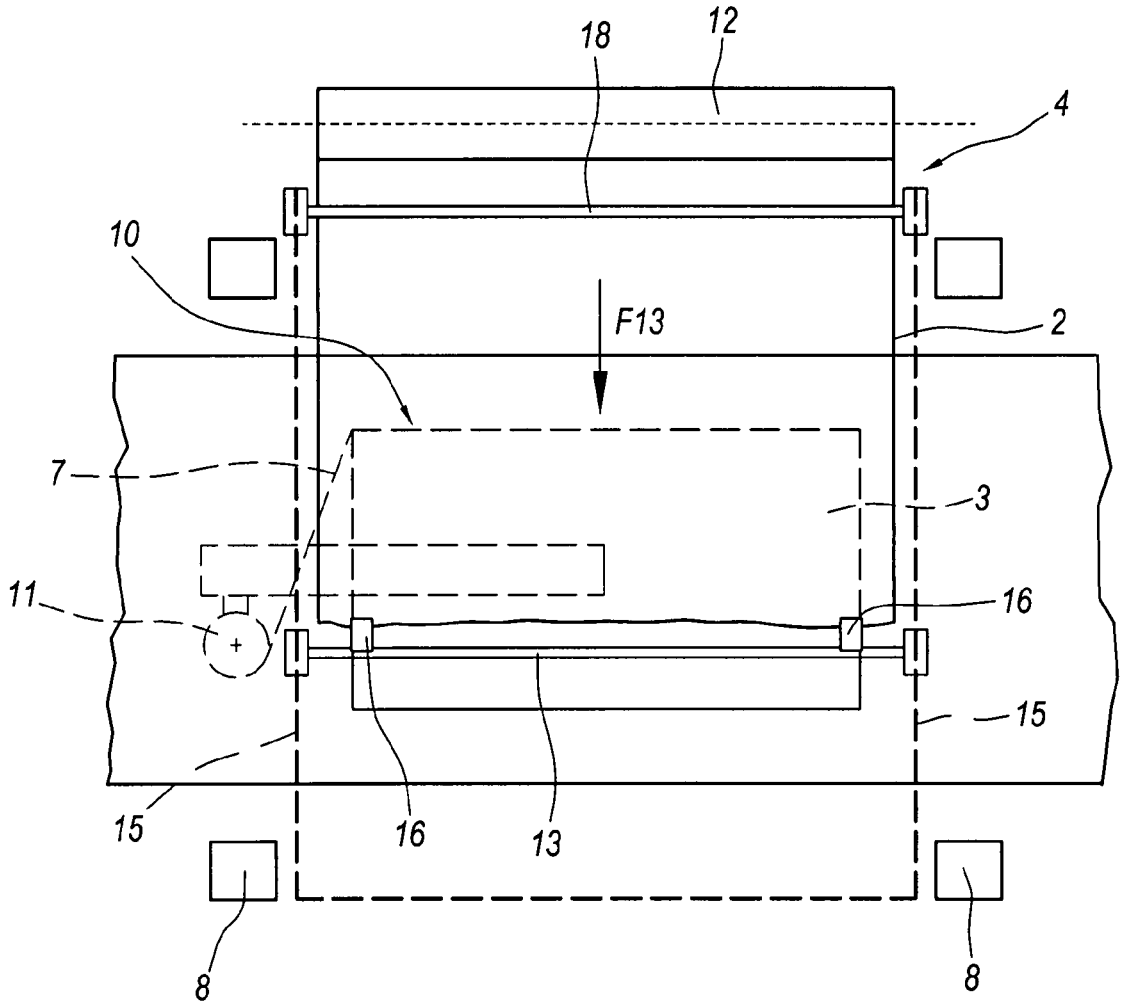

The unit 4 made in this way thus feeds the sheet 1 through the steps illustrated in FIG. 6 to 8, starting from the configuration shown in FIG. 6: first carriage 13 in position close to the free end of the film 2 and second carriage 18 facing the first carriage 13 in the vicinity of the second roll 12 and downstream of the cutting means 17 with respect to the unwinding direction F2 of the film 2.

The film 2 is unwound by the first carriage 13 for a predetermined length (dependent on the size of the product group 3) and the first carriage 13 is then stopped.

Next, while the cutting means 17 cut off the film 2, the second gripper unit 19 is activated and grips the sheet 1 by the end defined by the cut.

The means 20 for coupling the second carriage 18 with the drive belt 15 of the first carriage 13 are also activated.

At this point, when the belt 15 is restarted, it moves the two carriages 13 and 18 together as one until the sheet 1 is positioned centrally over the product group 3 (see FIG. 8).

Once the sheet 1 has been released by opening the gripper units 16 and 19, the belt 15 reverses its direction of travel and moves the second carriage 18 back to its starting position, where the coupling means 20 are disengaged, while the first carriage 13 continues moving until it reaches the position where it can pick up the free end of the film 2 again (FIG. 6).

A unit as described above fully achieves the aforementioned aims thanks to a simple structure that can operate at a good production speed and can position the film centrally on the product group (irrespective of its size) with a high level of repeatable accuracy. All of this is accomplished with a reduced number of fixed and mobile parts and with a single drive system for both the movement carriages.

The invention described has evident industrial applications and may be modified and adapted in several ways without thereby departing from the scope of the inventive concept. Moreover, all the details of the invention may be substituted by technically equivalent elements.

What is claimed is:

1. A unit for positioning a sheet of film to cover the tops of product groups, the unit being associated with an apparatus for wrapping the product groups with film and comprising a frame mounting at least one carriage that moves relative to the group of products to be wrapped with the film to define a wrapping area, said carriage mounting at least one first roll of film; the frame also mounting one positioning unit comprising at least:

a second, horizontally positioned roll of film;

a first carriage slidably mounted, on both sides, on guide rails running along an upper horizontal plane and driven in both directions along the wrapping area by a driving unit; the first carriage being equipped with a first gripper unit designed to grip the free end of the film and to unwind the film for a predetermined length dependent on the size of the product group;

a film cutter located in the vicinity of the second roll and designed to separate the length of film thus unwound from the rest of the film to define the sheet, wherein the unit comprises:

a second carriage slidably mounted on the guide rails opposite the first carriage and in the vicinity of the film cutter;

a second gripper unit mounted on the second carriage, acting on the film in such a way as to hold the sheet at a second retention point when the film cutter are activated;

means for coupling the second carriage to the driving unit in such a way that, when engaged, the two carriages move together as one in order to position the sheet centrally on the top surface of the product group to be covered; the second carriage being equipped with a supporting unit for supporting the passing film while it is being unwound by the first carriage;

the second gripper unit comprising at least one pair of supporting unit, each comprising contact plates associated with the second carriage and having an L-shaped portion protruding downwardly under the second carriage in such a way that its horizontal section supports the longitudinal edge film being unwound, a pair of vertical actuating pressers positioned on the second carriage in the vicinity of the plates in such a way as to face the horizontal section of the shaped portion, and mobile between an idle position where a working head of the rod is away from the horizontal section and a working position where the working head stops the film between the head and the horizontal section of the plate.

2. The unit according to claim 1, wherein the second carriage is equipped with a supporting unit for supporting the passing film while it is being unwound by the first carriage.

3. The unit according to claim 2, wherein the second gripper unit comprises:

at least one pair of supporting units, each comprising contact plates associated with the second carriage and having an L-shaped portion protruding downwardly under the second carriage in such a way that its horizontal section supports the longitudinal edge film being unwound;

a pair of vertical actuating pressers positioned on the second carriage in the vicinity of the plates in such a way as to face the horizontal section of the shaped portion, and mobile between an idle position where a working head of the rod is away from the horizontal section and a working position where the working head stops the film between the head itself and the horizontal section of the plate.

4. The unit according to claim 1, wherein the second carriage is equipped with a supporting unit for supporting the passing film while it is being unwound by the first carriage; said supporting unit defining a contact base for the second gripper unit enabling the second gripper unit to hold the sheet at the second retention point when the film cutter is activated.

5. The unit according to claim 1, where the driving unit comprise an endless belt trained around one pair of wheels, one of which is power-driven, for each mounting guide rail, wherein the coupling means are located at the two ends of the second carriage and act on a section of the respective belts with which the first carriage is stably associated.

6. The unit according to claim 5, where each mounting rail comprises a C section beam, the lower horizontal section of the C slidably supporting respective first wheel unit and a second wheel unit associated with the ends of the first carriage and second carriage, respectively, wherein each beam accommodates an inner C-section beam that is attached to the vertical section of the beam and positioned above the wheel units, the belt section to which the first carriage is attached slides inside the inner C section beam.

7. The unit according to claim 6, wherein the coupling means comprise a clamping member located at and associated with each end of the second carriage and at least partly and transversely engaging the respective inner C-beam in such a way as to face both sides of the section of the belt; each of the clamping members being acted upon by an actuator designed to move the clamping member between a configuration where the branch of the belt is stably gripped so as to perform the joint movement with the first carriage, and a configuration where the belt section is released.

8. The unit according to claim 7, wherein each clamping member comprises:

a fixed contact base attached to the second carriage, extending into the inner C-beam below the area where the section of the belt is engaged;

a mobile claw hinged at to a support of the second carriage and extending into the inner C-beam; the outside free end of the claw being acted upon by the actuator; one end of the actuator being linked to the second carriage while the other end is pivoted at to a drive arm attached to the mobile claw in such a way as to enable the claw to turn between a raised, idle position where the claw is away from the section of the belt and a lowered, working position where the claw is in contact with the belt section which is positioned between the claw itself and the fixed contact base.

9. The unit according to claim 8, wherein the mobile claw, in the idle position, is pressed against the upper side of the inner C-beam with an inclined profile surface of it in such a way as to stop the second carriage at the corresponding position.

10. A unit for positioning a sheet of film to cover the tops of product groups, the unit being associated with an apparatus for wrapping the product groups with film and comprising a frame mounting at least one carriage that moves relative to the group of products to be wrapped with the film to define a wrapping area, said carriage mounting at least one first roll of film; the frame also mounting one positioning unit comprising at least:

a second, horizontally positioned roll of film;

a first carriage slidably mounted, on both sides, on guide rails running along an upper horizontal plane and driven in both directions along the wrapping area by a driving unit; the first carriage being equipped with a first gripper unit designed to grip the free end of the film and to unwind the film for a predetermined length dependent on the size of the product group;

a film cutter located in the vicinity of the second roll and designed to separate the length of film thus unwound from the rest of the film to define the sheet, wherein the unit comprises:

a second carriage slidably mounted on the guide rails opposite the first carriage and in the vicinity of the film cutter;

a second gripper unit mounted on the second carriage, acting on the film in such a way as to hold the sheet at a second retention point when the film cutter are activated;

means for coupling the second carriage to the driving unit in such a way that, when engaged, the two carriages move together as one in order to position the sheet centrally on the top surface of the product group to be covered; said driving unit comprising an endless belt trained around one pair of wheels, one of which is power-driven, for each mounting guide rail; the coupling means being located at the two ends of the second carriage and acting on a section of the respective belts with which the first carriage is stably associated; each mounting rail comprising a C section beam, a lower horizontal section of the C slidably supporting respective first wheel unit and a second wheel unit associated with the ends of the first carriage and second carriage, respectively, wherein each beam accommodates an inner C-section beam that is attached to the vertical section of the beam and positioned above the wheel units, the belt section to which the first carriage is attached slides inside the inner C section beam.

11. The unit according to claim 10, wherein the coupling means comprise a clamping member located at and associated with each end of the second carriage and at least partly and transversely engaging the respective inner C-beam in such a way as to face both sides of the section of the belt; each of the clamping members being acted upon by an actuator designed to move the clamping member between a configuration where the branch of the belt is stably gripped so as to perform the joint movement with the first carriage, and a configuration where the belt section is released.

12. The unit according to claim 10, wherein the second gripper unit comprises:

at least one pair of supporting units, each comprising contact plates associated with the second carriage and having an L-shaped portion protruding downwardly under the second carriage in such a way that its horizontal section supports the longitudinal edge film being unwound;

a pair of vertical actuating pressers positioned on the second carriage in the vicinity of the plates in such a way as to face the horizontal section of the shaped portion, and mobile between an idle position where a working head of the rod is away from the horizontal section and a working position where the working head stops the film between the head itself and the horizontal section of the plate.

* * * * *